United States Patent [19]

Klein et al.

[11] 4,378,739

[45] Apr. 5, 1983

[54] PRIMER FIRING MEANS

[75] Inventors: Edward A. Klein, Florissant; Morry L. Schimmel, University City, both of Mo.

[73] Assignee: The United States of America as represented by the Secretary of the Navy, Washington, D.C.

[21] Appl. No.: 246,480

[22] Filed: Mar. 23, 1981

[51] Int. Cl.[3] ..... F42C 19/10

[52] U.S. Cl. ..... 102/204

[58] Field of Search ..... 102/200, 202, 204, 275.4, 102/275.5, 275.6, 275.7, 275.8, 275.9, 275.11, 102/275.12

[56] References Cited

U.S. PATENT DOCUMENTS

| | | | |
|---|---|---|---|
| 679,792 | 8/1901 | Stuart | 102/204 |
| 1,313,801 | 8/1919 | Doran | 102/204 |
| 1,400,554 | 12/1921 | Johnson | 102/204 |
| 1,491,000 | 4/1924 | Brandt et al. | 102/200 |
| 2,857,845 | 10/1958 | Seavey | 102/204 |
| 3,106,892 | 10/1963 | Miller | 102/275.9 |
| 3,129,663 | 4/1964 | Schnepfe, Jr. | 102/275.4 |
| 3,788,227 | 1/1974 | Clifton et al. | 102/70 R |
| 3,971,319 | 7/1976 | Larson | 102/24 R |
| 4,083,307 | 4/1978 | Beerman, et al. | 102/45 |
| 4,099,465 | 7/1978 | Haake | 102/204 |

*Primary Examiner*—Charles T. Jordan

*Attorney, Agent, or Firm*—Robert F. Beers; Frederick A. Wein

[57] ABSTRACT

A firing mechanism for detonating a plurality of percussion primers is presented. An explodable means and at least one percussion primer are disposed at opposite ends of a housing defining a cavity for transmitting explosive energy from the detonated explodable means to each of the percussion primers for firing the percussion primers. An orifice plate, secured within the cavity between the explodable means and the percussion primers is provided with plurality of apertures for providing passageways for transmitting the explosive energy from the explodable means to the percussion primers. The apertures are calibrated for metering the quantity of the explosive energy transmitted to the percussion primers and for providing substantially simultaneous initiation of the plurality of percussion primers. The apertures are off-set for substantially avoiding the striking of the percussion primers by fragments from the explodable means.

8 Claims, 1 Drawing Figure

PRIMER FIRING MEANS

BACKGROUND OF THE INVENTION

The present invention relates to a primer firing mechanism, and more particularly, to a firing mechanism for percussion primers wherein the explosive energy from a detonated explodable device is transmitted directly to the percussion primers for initiation of the percussion primers without use of an intermediary firing pin.

Commercially available percussion primers are constructed by the loading of an impact-sensitive pyrotechnic mix into a primer cup with the mix being covered by a paper disk and an anvil pressed into the cup. Normally, the primer is fired by impacting the primer cup face with a hemispherically tipped firing pin. The resulting compression of the mix between the indented cup face and the anvil causes the mix to deflagrate. This deflagration provides a flame for firing an externally disposed explodable device. The cups are made of ductile brass and copper alloys to permit deformation of the cup while maintaining structural integrity.

In the prior art, the firing of the percussion primer requires the use of an intermediary firing pin. The requirement of this intermediate firing pin for firing a primer, and particularly a percussion primer, is exemplified by U.S. Pat. Nos. 4,099,465 of Haake, 4,083,307 of Beermann et. al., 3,971,319 of Larson, 1,313,801 of Doran, and 679,792 of Stuart.

The use of a firing pin has particular disadvantages, notably comprising a moving part requiring close tolerances for firing the percussion primer. Accordingly, it is desirable to improve the reliability of the firing of percussion primers by the elimination of such moving parts. Additionally, such a reduction in the number of parts reduces fabrication, assembly, and test costs. Accordingly, it is desirable to provide a means for firing a percussion primer without the use of an intermediary firing pin.

For a primer firing mechanism it is desirable to use redundant primers within the same envelope for greater reliability. The redundancy of the primers is required to assure ignition in the event that one of the percussion primers is defective. Firing of the redundant primers using firing pins requires even more stringent tolerances and fabrication and assembly costs than that required for a single percussion primer, and additionally, presents a timing problem inasmuch as it is desirable that all of the primers be ignited at the same time. Accordingly, it is desirable to provide a means for substantially simultaneous firing of the percussion primers without using moving mechanical parts.

SUMMARY OF THE INVENTION

Briefly, the present invention relates to a firing mechanism for initiating a plurality of percussion primers. An explodable device is secured to a housing defining a cavity and communicating with the cavity for providing explosive energy within the cavity upon the detonation of the explodable device. At least one percussion primer having an output for firing an externally disposed explodable means is secured with respect to the housing and communicating with the cavity, the percussion primer being initiatable by the explosive energy provided by the detonation of the explodable device. A detonation coupling means is secured to the housing and disposed within the cavity between the explodable device and the percussion primers. The detonation coupling means is provided with a plurality of apertures or passgeways for transmitting to the percussion primers the explosive energy provided by the first explodable device for initiating the percussion primers, with the passageways providing for simultaneous initiation of the percussion primers. The size of the opening of the passageways is calibrated for regulating and metering the quantity of the explosive energy transmitted to each of the percussion primers. Additionally, the passageways are offset from the trajectory of the fragments from the explodable device.

OBJECTS OF THE INVENTION

Accordingly, with reference to the background of the invention hereinabove, it is an object of the present invention to provide a firing means for a percussion primer providing improved reliability by eliminating the use of an intermediary firing pin. Another object of the present invention is to fire the respective percussion primer directly by an explodable device without an intermediary firing pin. Still another object of the present invention is to provide for substantially simultaneously firing of a plurality of percussion primers. Yet another object of the present invention is to provide a calibrated means for metering and regulating the quantity of explosive energy transmitted to each of the percussion primers. A further object of the present invention is to provide means for firing a plurality of percussion primers directly by explosive energy from an explodable device wherein the striking of the percussion primers by fragments from the explodable device is substantially avoided.

Further objects and advantages of the present invention will become apparent as the following description proceeds and the features of novelty characterizing the invention will be pointed out with particularity in the claims annexed to and forming a part of this specification.

DESCRIPTION OF THE DRAWING

For a better understanding of the present invention reference may be had to the accompanying drawing wherein.

DETAILED DESCRIPTION OF THE PREFERRED EMBODIMENT

Figure 1:
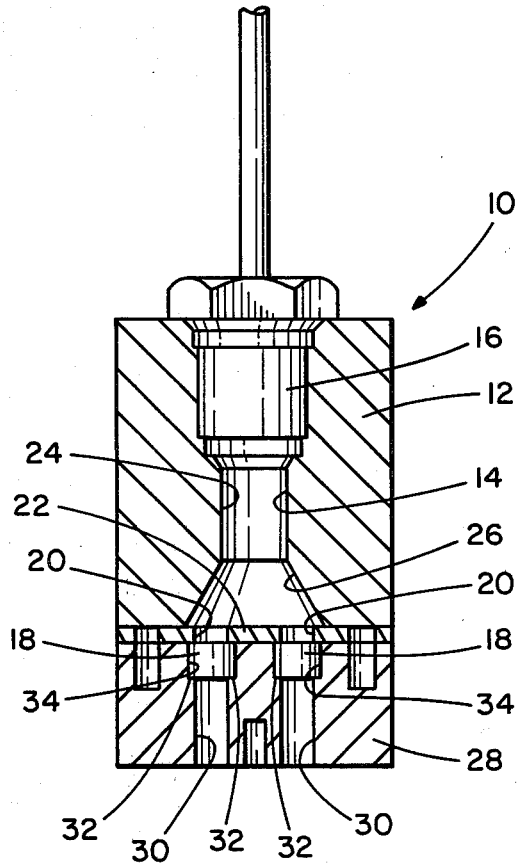
FIG. 1 shows, in cross section, a primer firing means for firing a plurality of percussion primers.

Referring now to the drawing wherein the same referenced numerals have been applied to like parts, FIG. 1 shows a primer firing means, generally designated 10, comprising a housing 12 defining an elongated cavity 14. In the exemplary embodiment, a Shielded Mild Detonating Cord (SMDC) 16, such as shown in U.S. Pat. No. 3,326,127 to Schimmel, also an inventor hereof, and expressly incorporated by reference herein, is securingly disposed at one end of the housing 12 within the cavity 14. A plurality of percussion primers 18, are secured with respect to housing 12 and communicate with cavity 14 through apertures 20 disposed within an orifice plate 22. Upon detonation of SMDC 16 explosive energy is generated within cavity 14, and is transmitted through orifice plate 22, by apertures 20 serving as passageways, to the percussion primers 18 causing percussion primers 18 to fire.

In the exemplary embodiment, the percussion primer is fired by the blast of explosive energy instead of by the impact of firing pin. As in the case of the firing pin, the blast pressure deflects the primer cup face inwardly around the anvil to compress the mix and causing it to deflagrate or fire as explained hereinabove. The percussion primers used in the exemplary embodiment are commonly commercial types, e.g., M42C1, made by Olin Co. and 49G11 made by the Remington Co.

More particularly, the SMDC used in the exemplary embodiment is a standard commercially available device designed for this purpose and provides an explosive input comprising explosive energy made up of a shockwave of high pressure gas propelled by the detonation of SMDC 16 into the cavity 14. Accordingly, the housing 12 is made of appropriate materials with sufficient structural integrity to withstand the detonation blast without damage with SMDC 16 being secured at one end of the elongated cavity 14, by appropriate means, i.e., screw machine threads, or the like.

The cavity 14 comprises an elongated barrel portion 24 disposed proximal the installed SMDC 16, and truncated conical portion 26 disposed proximal the orifice plate 22 for allowing the gases to expand into the apertures 20 thereby firing the percussion primers by direct impact of the blast from the detonated SMDC without an intermediary firing pin.

Apertures 20 of orifice plate 22 are disposed adjacent the respective percussion primers 18, forming passageways for conducting the blast of explosive energy from SMDC 16 to percussion primers 18. The orifice plate 22 is generally planar and secured by appropriate means to the housing 12.

A retaining member 28 provides a housing for each of the plurality of the percussion primers 18, securing the percussion primers in place proximate the respective apertures 20. Retaining member 28 is secured by appropriate means (not shown) to housing 12, and thereby also secures the orifice plate 22 in place to the housing 12.

Retaining member 28 is provided with a plurality of bores 30 communicating with a respective primer 18. The respective percussion primer 18 is securingly supported by retaining member 18 in communication with a respective bore 30 by a ledge 32 formed by the intersection of the dissimilar diameters of the respective bore 30 with the respective cavity 34 within which the respective primer 18 is nested and secured by retaining member 28. When the respective percussion primer 18 is fired, the resulting fire or deflagration is transmitted by the respective bore 30 for detonating an external explodable device in a manner similar to that shown in U.S. Pat. No. 1,313,801 of Doran, supra.

It is often desirable to provide more than one percussion primer for a particular application. Such a plurality of percussion primers provide improved reliability by providing redundancy in the event one of the primers 18 is defective, and enable achieving a greater output when one percussion primer would not have sufficient output for the intended application. Although the exemplary embodiment discloses a firing mechanism for two percussion primers, it is understood that similar principles apply to firing a single percussion primer as well as more than two.

In the case requiring a plurality of percussion primers for an increase of the resulting deflagration, it is necessary that each of the plurality of percussion primers be substantially simultaneously initiated so that the effect derived from the fired percussion primers will be cumulative. Such a substantially simultaneous firing of a plurality of percussion primers by firing pins is difficult to achieve and requires precise control and machining of the intermediary parts. The simultaneous initiation of each of the plurality of the percussion primers is easily achieved with the device disclosed therein.

When SMDC 16 is detonated, in addition to the blast of explosive energy provided by the detonation, a plurality of fragments are propelled from the SMDC 16, such fragments being the residue of the containment wall of the tip of SMDC 16. The fragments are carried along with the blast of explosive energy and it has been found to be desirable to prevent these fragments from striking the percussion primers. In order to prevent such striking of the percussion primers by fragments from the SMDC 16, the apertures 20 of orifice 22 are offset from the center line direction of travel of the blast of explosive energy within cavity 14.

Various percussion primers of different makes and models having different firing requirements are useable by the present percussion firing mechanism. Accordingly, the apertures 20 are calibrated for providing a means for metering and regulating the quantity of the explosive energy transmitted to each of the percussion such that the quantity of such explosive energy will be guaranteed to be sufficient for firing the model of percussion primer used but not of such quantity as to adversely effect the firing of the respective percussion primer. To accomodate such diversity of percussion primers, a suitable orifice plate 22 can be matched for the particular percussion primer used for a particular application.

A commonly used SMDC 16 provides an explosive energy output averageing 400 inch-pounds with a minimum output specified requirement of 200 inch-pounds. A typical percussion primer such as the M42C1 has a firing energy requirement of 26 inch-ounces or just under 2 inch-pounds. The excess energy available from the SMDC is attenuated by the size of the apertures 20 in the orifice plate 22 by a calibrated predetermined size of the orifice. In the exemplary embodiment, it has been found that for the percussion primer M42C1, firing occured from the impact of the metered blast of explosive energy through hole diameter sizes between 0.125 inches down to 0.030 inchs. Although the apertures 20 used in the exemplary embodiment were circular, it is within the contemplation of the present invention that other apertures configurations can be used. It should also be noted that some attentuation of the excess energy available from the SMDC 16 can be achieved by design of the length of travel of the blast of explosive energy within the cavity 14.

Thus there is disclosed a firing mechanism for detonating at least one percussion primer. An explodable device and at least one percussion primer are disposed at opposite ends of a housing having a cavity for transmitting explosive energy from the explodable device (SMDC) to each of the percussion primers for initiation of the percussion pirmers. A detonation coupling means comprising a substantially planar orifice plate is secured within the cavity between the explodable means and the percussion primers in a plane generally normal to the direction of travel of the explosive energy from the explodable means. The orifice plate is provided with a plurality of apertures providing passageways for transmitting the explosive energy from the explodable device to the percussion primers. The apertures in the orifice plate are calibrated for metering the quantity of the explosive energy transmitted to each of the percussion primers. The apertures are also offset from the center line of travel of the blast of explosive energy for substantially avoiding the striking of the percussion primers by fragments of the explodable means.

While there has been illustrated and described what is at present considered the preferred embodiment of the present invention, it will be appreciated that numerous changes and modifications are likely to occur to those skilled in the art and it is intended in the appended claims to cover all those changes and modifications which fall within the true spirit in scope of the present invention.

What is claimed as new and desired to be secured by Letters Patent is:

1. A firing mechanism for detonating at least two percussion primers comprising:

a housing defining a cavity, an explodable means secured to the housing and communicating with the cavity for providing an explosive energy within the cavity upon detonation of the explodable means, at least two percussion primers having an output upon detonation of the explodable means for firing an external explodable device, each of the at least two percussion primers being secured with respect to the housing and having means communicating with the cavity and detonatable by the explosive energy, and a detonation coupling means secured to the housing and disposed within the cavity between the explodable means and the at least two percussion primers, the detonation coupling means being provided with at least two passageways for transmitting to the at least two percussion primers the explosive energy provided by the explodable means for initiating the at least two percussion primers, the length and direction of travel provided by the at least two passageways for the explosive energy providing means for the substantially simultaneous initiation of the at least two percussion primers.

2. The firing mechanism of claim 1 wherein the explosive energy comprises a shock wave of high pressure gas propelled by the detonation of the explodable means.

3. A firing mechanism for detonating at least one percussion primers comprising:

a housing defining a cavity, an explodable means secured to the housing and communicating with the cavity for providing an explosive energy within the cavity upon detonation of the explodable means, at least one percussion primers having an output upon detonation of the explodable means for firing an external explodable device, each of the at least one percussion primers being secured with respect to the housing and having means communicating with the cavity and detonatable by the explosive energy, and a detonation coupling means secured to the housing and disposed within the cavity between the explodable means and the at least one percussion primers, the detonation coupling means being provided with at least one passageways for transmitting to the at least one percussion primers the explosive energy provided by the explodable means for initiating the at least one percussion primers, the at least one passageways comprising respectively calibrated apertures providing means for regulating the quantity of the explosive energy transmitted to each of the respective at least one percussion primers.

4. A firing mechanism for detonating at least one percussion primers comprising:

a housing defining a cavity, an explodable means secured to the housing and communicating with the cavity for providing an explosive energy within the cavity upon detonation of the explodable means, at least one percussion primers having an output upon detonation of the explodable means for firing an external explodable device, each of the at least one percussion primers being secured with respect to the housing and having means communicating with the cavity and detonatable by the explosive energy, and a detonation coupling means secured to the housing and disposed within the cavity between the explodable means and the at least one percussion primers, the detonation coupling means being provided with at least one passageways for transmitting to the at least one percussion primers the explosive energy provided by the explodable means for initiating the at least one percussion primers, the at least one passageways being disposed for substantially avoiding the striking of the at least one percussion primers by fragments from the explodable means.

5. A firing mechanism for detonating at least one percussion primers comprising:

a housing defining a cavity, an explodable means secured to the housing and communicating with the cavity for providing an explosive energy within the cavity upon detonation of the explodable means, at least one percussion primers having an output upon detonation of the explodable means for firing an external explodable device, each of the at least one percussion primers being secured with respect to the housing and having means communicating with the cavity and detonatable by the explosive energy, and a detonation coupling means secured to the housing and disposed within the cavity between the explodable means and the at least one percussion primer, the detonation coupling means being provided with at least one passageways for transmitting to the at least one percussion primers the explosive energy provided by the explodable means for initiating the at least one percussion primers, the detonation coupling means comprising an orifice plate and the at least one passageways comprising apertures extending through the thickness of the orifice plate.

6. The firing mechanism of claim 5 wherein the orifice plate is substantially planar and is disposed in a plane normal to the direction of travel of the explosive energy from the explodable means.

7. The firing mechanism of claim 5 wherein the orifice plate provides means for securingly engaging each of the at least one percussion primers.

8. A firing mechanism for detonation of a plurality of percussion primers comprising:

a housing defining a cavity, an explodable means secured to the housing and communicating with the cavity for providing an explosive energy comprising a shock wave of high pressure gas within the cavity upon detonation of the explodable means, a plurality of percussion primers providing an output upon detonation of the explodable means for firing an external explodable device, each of the plurality of primers communicating with the cavity and detonatable by the explosive energy, and a detonation coupling means secured to the housing and disposed within the cavity between the explodable means and the plurality of percussion primers, the detonation coupling means comprising an orifice plate having a plurality of apertures extending through the thickness of the aperture plate and providing means for securingly engaging each of the plurality of percussion primers with respect to the housing, the length and direction of travel of the apertures providing for substantially simultaneous initiation of each of the plurality of percussion primers, the areal extent of the apertures providing means for regulating the quantity of the explosive energy transmitted to the plurality of percussion primers, the apertures being disposed for substantially avoiding the striking of the plurality of percussion primers by fragments from the explodable means.

* * * * *